United States Patent [19]

Sakaguchi et al.

[11] Patent Number: 4,587,206

[45] Date of Patent: May 6, 1986

[54] METHOD FOR FORMING IMAGES

[75] Inventors: Yukihiko Sakaguchi; Toshiaki Aono; Shinsaku Fujita, all of Kanagawa, Japan

[73] Assignee: Fuji Photo Film Co., Ltd., Kanagawa, Japan

[21] Appl. No.: 594,634

[22] Filed: Mar. 29, 1984

[30] Foreign Application Priority Data

Mar. 30, 1983 [JP] Japan ..... 58-54168

[51] Int. Cl.[4] ..... G03C 1/02

[52] U.S. Cl. ..... 430/348; 430/607; 430/617; 430/351; 430/559; 430/562

[58] Field of Search ..... 430/607, 617, 351, 348, 430/559, 562

[56] References Cited

U.S. PATENT DOCUMENTS 4,411,984 10/1983 Gabrielsen ..... 430/619

OTHER PUBLICATIONS

Baxendale, et al., of SN 825,478 filed Mar. 28, 1969, published in O.G. 748 on Oct. 21, 1969.

*Primary Examiner*—Won H. Louie

*Attorney, Agent, or Firm*—Sughrue, Mion, Zinn, Macpeak, and Seas

[57] ABSTRACT

A method for forming an image is disclosed, which comprises heating a light-sensitive material having on a support, a light-sensitive silver halide, a binder and a dye releasing redox compound capable of releasing a dye through the reaction with the silver halide by heating, after or simultaneously with imagewise exposure, in the presence of a compound represented by the formula (A):

wherein R is an aliphatic group with a valence of m+n, $R^1$ is an aliphatic or aromatic group, and m and n are each an integer of 1 to 5. The presence of the compound markedly improves the stability of the light-sensitive material during its storage prior to the heat development.

20 Claims, No Drawings

METHOD FOR FORMING IMAGES

FIELD OF THE INVENTION

The present invention relates to a novel method for forming dye images by heating in a substantially water-free condition. The present invention further relates to a novel heat developable color light-sensitive material containing dye releasing redox compounds which release a hydrophilic dye on reacting with light-sensitive silver halide when heated in a substantially water-free condition. Particularly the present invention relates to a novel method for forming dye images by transferring a dye released by heating into a dye-fixing layer.

BACKGROUND OF THE INVENTION

A photographic process utilizing silver halide has heretofore been most widely used since it is superior in photographic characteristics such as sensitivity and control of gradation to other photographic processes such as an electrophotographic process and a diazo photographic process. For photographic processing of light-sensitive materials using silver halide, a technique has recently been developed which enables to form images in a simplified manner and rapidly by substituting a dry processing system including a heating process for a conventional wet processing system utilizing developing solutions.

Heat developable light-sensitive materials are known in the art, and their details (including their processes of preparation) are described in, for example, *Shashin Kogaku No Kiso,* published by Corona Co. (1979), pages 553–555, Eizo Joho, published April 1978, page 40, *Nebletts Handbook of Photography and Reprography,* 7th ed., Van Nostrand Reinhold Company, pages 32–33, U.S. Pat. Nos. 3,152,904, 3,301,678, 3,392,020, 3,457,075, British Pat. Nos. 1,131,108, 1,167,777, and *Research Disclosure,* June 1978, pages 9–15 (RD-17029).

Many processes have been proposed for the formation of color images by the dry processing system.

One of the processes is to form color images by coupling an oxidized product of a developing agent with a coupler. In connection with this process, U.S. Pat. No. 3,531,286 discloses p-phenylenediamines as reducing agents and phenolic or active methylene couplers; U.S. Pat. No. 3,761,270 discloses p-aminophenol-based reducing agents; Belgian Pat. No. 802,519 and *Research Disclosure,* September 1975, pages 31–32 disclose sulfonamide-based reducing agents; and U.S. Pat. No. 4,021,240 discloses a combination of sulfonamidophenol-based reducing agents and four equivalent couplers.

In this process, an image of reduced silver and a color image are formed simultaneously in exposed areas by heat development and, therefore, the color image becomes cloudy or turbid. Although several processes have been proposed, including a process of removing the silver image by application of a liquid treatment and a process of transferring only the dye into another layer such as a sheet carrying an image-receiving layer, it is very difficult to distinguish between the unreacted material and dye and then to transfer the dye only.

Another process is described in *Research Disclosure,* May 1978, pages 54–58 (RD-16966) in which a nitrogen-containing heterocyclic ring is introduced in a dye, and a silver salt is formed and then the dye is released by heat development. In accordance with this process, however, it is difficult to control the release of dye in unexpected areas and thus a sharp image cannot be formed. Hence this process is not suitable for practical use.

Another process is to form positive color images by the heat-sensitive silver dye bleaching process. Useful dyes and bleaching techniques are described in, for example, *Research Disclosure,* April 1976, pages 30–32 (RD-14433), ibid., December 1976, pages 14–15 (RD-15227), and U.S. Pat. No. 4,235,957. This process, however, requires addition operation steps and materials in order to accelerate the bleaching of dye; for example, an activator sheet should be superposed and heated. Furthermore, this process has a disadvantage in that color images formed are gradually reduced and bleached by coexisting free silver, for example, during their long term storage.

Another process is to form color images utilizing leuco dyes, as described in, for example, U.S. Pat. Nos. 3,985,565 and 4,022,617. One of the defects of the process is that leuco dyes are difficult to stably incorporate in photographic material and thus the photographic material is gradually colored during the storage thereof.

The present invention is intended to overcome the above-described problems of the known light-sensitive materials, and provides a novel method for forming dye images by heating in a substantially water-free condition.

SUMMARY OF THE INVENTION

An object of the invention is to provide a novel method for forming an image in which a mobile hydrophilic dye released upon heating in a substantially water-free condition is transferred into a dye-fixing layer to obtain a dye image.

Another object of the invention is to provide a method for improving stability with a passage of time.

The term "stability with a passage of time" is used herein to mean the stability of a light-sensitive material during its storage prior to heat development. That is, improving the stability with a passage of time is to prevent the formation of fog and a change in maximum density of light-sensitive materials during their storage prior to heat development.

An object of the invention is to provide a method for forming sharp dye images in a simple manner.

The present invention relates to a method for forming an image which comprises heating a heat developable color light-sensitive material comprising a support having thereon at least a light-sensitive silver halide, a binder, and a dye releasing redox compound capable of reducing said silver halide and releasing a hydrophilic dye by reacting with said silver halide when heated, after or simultaneously with imagewise exposure, in the presence of a compound represented by the following general formula (A) in a substantially water-free condition to form a mobile dye in an image pattern:

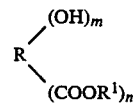

(A)

wherein R is an aliphatic group having a valence of m+n, $R^1$ is an aliphatic or aromatic group, and m and n each is an integer of 1 to 5.

DETAILED DESCRIPTION OF THE INVENTION

The aliphatic group represented by R in the general formula (A) is preferably a 2–6 valent saturated or unsaturated hydrocarbon group having 1 to 60 carbon atoms, more preferably a 2–5 valent saturated or unsaturated hydrocarbon group having 1 to 40 carbon atoms and most preferably a 2–5 valent saturated or unsaturated hydrocarbon group having 1 to 20 carbon atoms.

The aliphatic group represented by R in the general formula (A) may be substituted by, for example, a halogen atom (e.g., a chlorine atom, a bromine atom, and a fluorine atom) and an alkoxyl group (e.g., containing 1 to 40 carbon atoms).

$R^1$ preferably has 1 to 60 carbon atoms, more preferably 1 to 40 carbon atoms, and most preferably 1 to 20 carbon atoms.

Specifically, $R^1$ is preferably an alkyl group, a substituted alkyl group, an alkenyl group, a substituted alkenyl group, a cycloalkyl group, a substituted cycloalkyl group, a phenyl group, or a substituted phenyl group. The alkyl group may be straight or branched.

Preferred examples of $R^1$ are a substituted or unsubstituted alkyl group having 1 to 40 carbon atoms and a substituted or unsubstituted cycloalkyl group having 1 to 40 carbon atoms.

More preferred is an alkyl group having 1 to 20 carbon atoms, which may be straight or branched. Examples of the alkyl group represented by $R^1$ are a methyl group, an ethyl group, a propyl group, an isopropyl group, a butyl group, an isobutyl group, a sec-butyl group, a tert-butyl group, a pentyl group, a hexyl group, a 2-methylpentyl group, a 2-ethylbutyl group, a heptyl group, a 2-ethylhexyl group, an octyl group, an isononyl group, a decyl group, an isodecyl group, an undecyl group, a dodecyl group, a tridecyl group, an isotridecyl group, a tetradecyl group, a hexadecyl group, a 2-hexyldecyl group, a 2-octyldodecyl group, an isooctadecyl group, an octadecyl group, and a 2-heptylundecyl group.

Another more preferred example of $R^1$ is a cycloalkyl group having 1 to 20 carbon atoms. Examples of the cycloalkyl group represented by $R^1$ are a cyclopentyl group, a cyclohexyl group, a cycloheptyl group, a cyclooctyl group, a 3,3-dimethylcyclohexyl group, a 3,3,5-trimethylcyclohexyl group, a 2-methylcyclohexyl group, a 4-tert-butylcyclohexyl group, and a cyclododecyl group.

The aliphatic or aromatic group represented by $R^1$ may be substituted by, for example, a halogen atom (e.g., a chlorine atom, a bromine atom, and a fluorine atom), an alkyl group (e.g., containing 1 to 20 carbon atoms), an alkenyl group (e.g., containing 1 to 20 carbon atoms), an aryl group (e.g., containing 1 to 20 carbon atoms), and an alkoxyl group (e.g., containing 1 to 20 carbon atoms).

Preferred examples of the compounds of the general formula (A) are those compounds in which m is 1 or 2, and n is 1, 2 or 3.

More preferred examples are those compounds in which m is 1, n is 1, and R is an alkylene chain or alkenylene chain. Particularly useful examples of the compounds of the general formula (A) are 12-hydroxystearic acid esters, ricinolic acid esters, and lactic acid esters.

Other more preferred examples are those compounds in which m is 1, n is 2, and R is a trivalent saturated hydrocarbon group (e.g., alkyl radical). Particularly useful examples are malic acid esters.

Other more preferred examples are those compounds in which m is 2, n is 2, and R is a tetravalent saturated hydrocarbon group (e.g., alkyl radical). Particularly useful examples are tartaric acid esters.

Other more preferred examples are those compounds in which m is 1, n is 3, and R is a tetravalent saturated hydrocarbon group (e.g., alkyl radical). Particularly useful examples are citric acid esters.

Typical examples of the compounds of the general formula (A) are shown below.

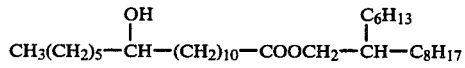
Compound 1

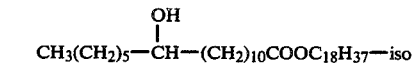
Compound 2

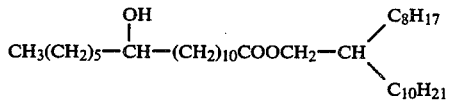
Compound 3

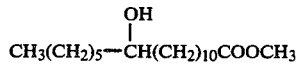
Compound 4

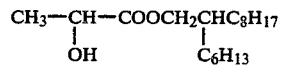
Compound 5

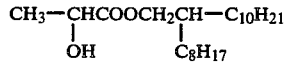
Compound 6

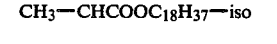
Compound 7

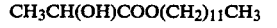
Compound 8

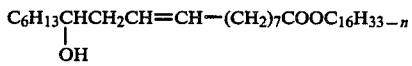
Compound 9

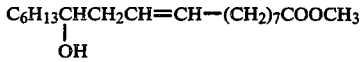
Compound 10

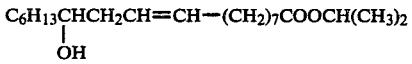
Compound 11

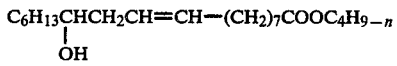
Compound 12

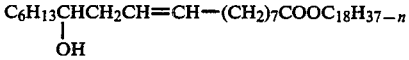
Compound 13

Compound 14

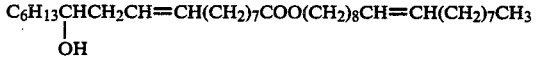

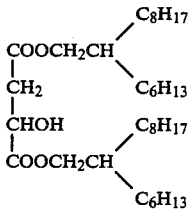
Compound 15

-continued
Compound 16
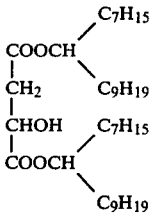
Compound 17
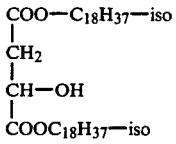
Compound 18
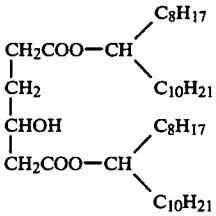
Compound 19
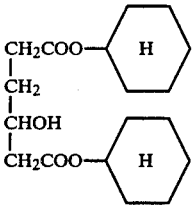
Compound 20
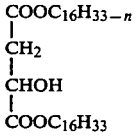
Compound 21
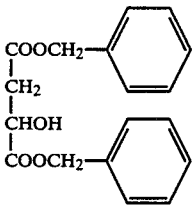
Compound 22
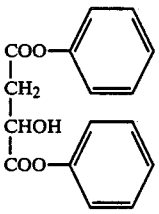
Compound 23
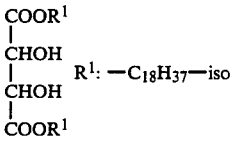
-continued
Compound 24
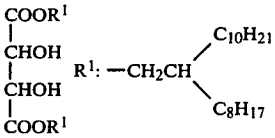
Compound 25
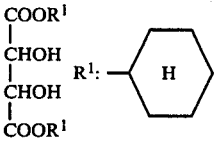
Compound 26
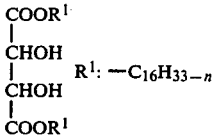
Compound 27
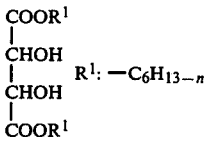
Compound 28
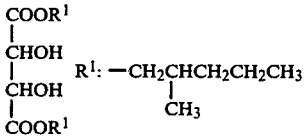
Compound 29
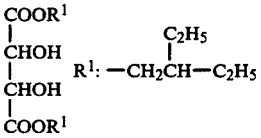
Compound 30
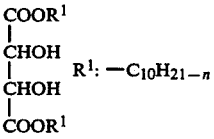
Compound 31
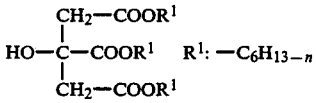
Compound 32
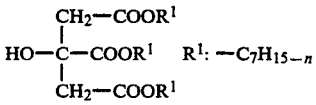
Compound 33
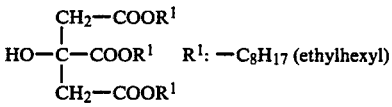
Compound 34
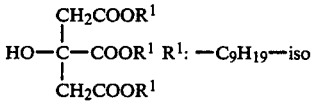
Compound 35
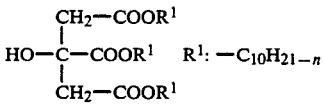

-continued

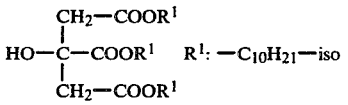

Compound 36

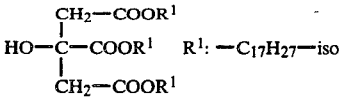

Compound 37

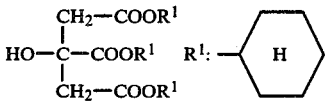

Compound 38

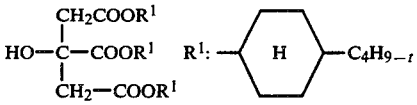

Compound 39

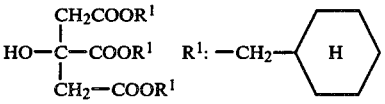

Compound 40

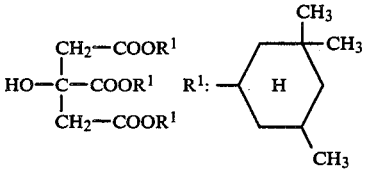

Compound 41

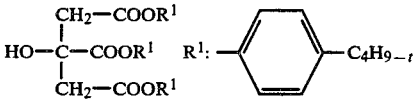

Compound 42

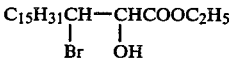

Compound 43

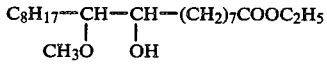

Compound 44

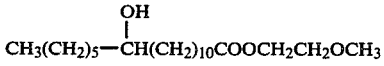

Compound 45

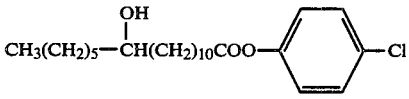

Compound 46

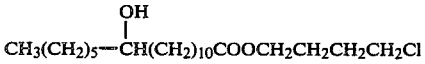

Compound 47

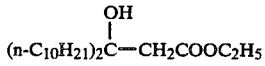

Compound 48

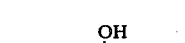

Compound 49

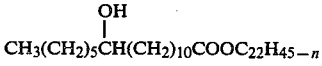

Compound 50

In addition, the compounds described in *Yushi Kagaku Binran,* revised 2 ed., Maruzen Co. (1971), pages 108–115 (Tables 2-31, 2-34, 2-36, 2-39, and 2-47) can be given as examples of the compounds of the general formula (A).

The compounds of the general formula (A) can be prepared by various procedures. The usual method of preparation of esters is described in, for example, *Shin Jikken Kagaku Koza,* Maruzen Co. (1977), Vol. 14 (II), page 1,000, and *Organic Functional Group Preparations,* Academic Press (1968), pages 245–268.

The methods described in H. Bertsch, H. Reinheckel, & G. Czichocki, *Fette, Seifen, Anstrichmittel,* 67, 780–783 (1965) and J. R. Sowa & G. S. Marbel, J. Polymer Sci., Part A-1, 5, 1501 (1967) are also useful for the preparation of the compounds of the general formula (A).

For the preparation of the compounds of the general formula (A), a method of condensing carboxylic acids represented by the following formula (B) as described hereinafter with alcohols or phenols represented by the formula $R^1OH$ in the presence of acids is easy to conduct and furthermore produces good results:

$$(HO)_m—R—(COOH)_n \qquad (B)$$

wherein m and n are the same as defined in the general formula (A). Also, a method in which acetals derived from $R^1OH$ are used in place of $R^1OH$ is useful for the preparation of the compounds of the general formula (A).

Preferred examples of hydroxycarboxylic acid, dihydroxycarboxylic acid, hydroxydicarboxylic acid, dihydroxydicarboxylic acid, trihydroxycarboxylic acid, trihydroxydicarboxylic acid, trihydroxytricarboxylic acid, dihydroxytricarboxylic acid and hydroxytricarboxylic acid represented by the formula (B) as shown below.

$CH_3—CH(OH)—COOH$ B-1

$HO(CH_2)_3COOH$ B-2

$C_2H_5—CH_2—C(CH_3)(OH)COOH$ B-3

$HO—(CH_2)_{10}COOH$ B-4

$CH_3(CH_2)_{15}—CH(OH)—COOH$ B-5

$CH_3(CH_2)_5—CH(OH)—CH_2CH=CH—(CH_2)_7COOH$ B-6

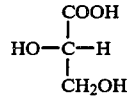

B-7

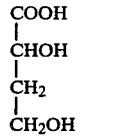

B-8

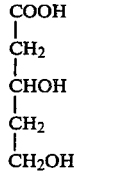

B-9

$C_2H_5—CH_2—CH(OH)—CH(OH)—COOH$ B-10

$[HO(CH_2)_3]_2CHCOOH$ B-11

-continued $CH_3(CH_2)_7CH(OH)CH(OH)(CH_2)_7COOH$ B-12

```
COOH
|
CHOH
|
CH2COOH
```
B-13

```
COOH
|
CHOH
|
CHOH
|
COOH
```
B-14

$HOCH_2C(C_2H_5)(COOH)_2$ B-15

These compounds may be any of stereoisomers (e.g., optical isomers, erythro forms, threo forms, meso forms, cis forms, and trans forms) included in the general formula (B), and their mixtures.

The compounds described in *Yushi Kagaku Binran,* revised 2 ed., Maruzen Co. (1971), pages 108–116 (in particular, Tables 2-31, 2-34, 2-35, 2-36, 2-37, 2-38, 2-41, 2-42, 2-43, 2-44, 2-46, and 2-48) can be given as examples of the acids represented by the formula (B).

A method of preparation of Compound 4 is described below.

PREPARATION EXAMPLE

Synthesis of Compound 4

12-Hydroxystearic acid (200 g) was mixed with 1,000 ml of methanol (preferably adding 20 ml of 2,2-dimethoxypropane(acetonedimethyl acetal)), and 2 ml of sulfuric acid was added thereto. The mixture was then refluxed for 5 hours. After cooled, the reaction mixture was poured into 4,000 ml of water (containing 5 g of sodium acetate). Crystals precipitated were collected by filtration and purified by distillation. There was thus prepared the desired product, b.p., 180°–187° C. (at 0.025 mmHg). The yield was 180 g.

Cosmole 115, 112 and 113 (products manufactured by Nissin Seiyu Co., Ltd.) were purified and used as Compounds 1 to 3 of the present invention.

Cosmole 13 and 12 (products manufactured by Nisshin Seiyu Co., Ltd.), and Cosmole 225, 224, 222 and 223 (products manufactured by Nisshin Seiyu Co., Ltd.) were also purified and used as, respectively, Compounds 6 and 7, and Compounds 15 to 18. The other compounds (e.g., Compound 31, b.p. 230° C./1 mmHg) were prepared in the same manner as in Preparation Example as described above.

The compounds of the present invention may be used, solely or in combination with each other, and are dispersed in an aqueous solution of hydrophilic colloid by the aid of dispersing agents. This method of dispersion is described in, for example, U.S. Pat. Nos. 2,304,939, 2,322,027, 2,801,170, 2,801,171, and 2,949,360.

In this case, the compounds of the present invention can be used in combination with high boiling organic solvents such as phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), benzoic acid esters (e.g., octyl benzoate), alkylamides (e.g., diethyllaurylamide), and fatty acids esters (e.g., dibutoxyethyl succinate and dioctyl acetate).

Usually the compounds of the present invention are dispersed in an aqueous solution of hydrophilic colloid in combination with dye-releasing redox compounds and low boiling organic solvents having a boiling point ranging between about 30° and 160° C. by the aid of dispersing agents. If desired, other photographic additives can be dispersed at the same time.

Low boiling organic solvents having a boiling point ranging between about 30° and 160° C. which can be used in the present invention include lower alkyl acetates such as ethyl acetate and butyl acetate, ethyl propionate, secbutyl alcohol, methyl isobutyl ketone, $\beta$-ethoxyethyl acetate, methyl cellosolve acetate, and cyclohexanone.

As these dispersing agents, usually, anionic surface active agents (e.g., sodium alkylbenzenesulfonate, sodium dioctylsulfosuccinate, sodium dodecylsulfate, sodium alkylnaphthalenesulfonate, and Fischer type couplers), amphoteric surface active agents (e.g., N-tetradecyl-N,N-dipolyethylene-$\alpha$-betaine), and nonionic surface active agents (e.g., sorbitan monolaurate) are used. In addition, the surfactants described in other parts of the present specification can be used as dispersing agents.

A dispersion composed of compounds of the present invention and dye-releasing redox compounds can be added to any one or both of an emulsion layer, such as a silver halide emulsion layer and an intermediate layer of heat developable light-sensitive material. On the other hand, a dispersion composed of compounds of the present invention without dye-releasing redox compounds can be incorporated in a hydrophilic colloid layer (e.g., a surface protective layer and an intermediate layer) and an emulsion layer (e.g., a silver halide emulsion layer) of heat developable light-sensitive material, or a mordant-containing layer of a fixing material as described hereinafter, or other suitable layers. Incorporation of the compounds of the present invention in such layers of light-sensitive material can be performed by known techniques such as the method described in U.S. Pat. No. 2,322,027.

The compounds of the present invention are usually added in an amount of 0.01 to 20 times (by weight), preferably 0.01 to 5 times (by weight) as much as dye-releasing redox compounds.

The term "dye image" as used herein includes both panchromatic and monochromatic dye images. In this case, the monochromatic dye image includes a monochromatic dye image resulting from mixing of two or more dyes.

In accordance with the method for forming images of the present invention, a silver image can be formed simultaneously with the formation of mobile dye in areas corresponding to the silver image only by heating after imagewise exposure. That is, in the method of the present invention, when a heat developable color light-sensitive material is exposed imagewise and then heat-developed in a substantially water-free condition, a redox reaction will occur between the light-sensitive silver halide and the dye-releasing redox compound with the exposed light-sensitive silver halide as a catalyst, resulting in the formation of a silver image in exposed areas. At this stage, the dye-releasing redox compound is oxidized into the oxidized form, releasing a hydrophilic mobile dye. As a result, in the exposed areas, the silver image and mobile dye are formed. If there are dye-releasing activators at that time, the foregoing reaction is accelerated. A dye image can be obtained by transferring the mobile dye into, for example, a dye-forming layer.

Although the above explanation has been made with reference to a case in which negative type of emulsions are used, autopositive emulsions can be used with the same results as above except that a silver image and mobile dye are formed in unexposed areas.

In the present invention, the redox reaction between the light-sensitive silver halide and the dye-releasing redox compound, and the subsequent dye-releasing reaction are characterized in that they proceed at elevated temperatures and furthermore in a substantially water-free dry condition. The term "elevated temperature" is used herein to mean a temperature of at least 80° C. The term "substantially water-free dry condition" is used herein to refer to a condition which is in an equilibrium state with moisture in air, but in which no water is supplied outside the system. This condition is described in *The Theory of the Photographic Process*", 4th ed., edited by T. H. James, Macmillan, page 374. In the method of the present invention, a sufficiently high reaction rate can be obtained in such substantially water-free conditions. This can be confirmed by the fact that the reaction rate of a light-sensitive material sample does not drop even after it is dried for one day under $10^{-3}$ mmHg.

It has been believed that the dye-releasing reaction occurs by the attack of so-called nucleophilic reagents, and it has been usually conducted in liquid having a pH as high as at least 10. It is, therefore, unexpected that a high reaction rate can be obtained under the conditions of the present invention; i.e., at elevated temperatures and in a substantially water-free condition. Furthermore, in the method of the present invention the dye-releasing redox compounds undergo a redox reaction with silver halide without help of so-called auxiliary developing agents. These are unexpected results in view of the knowledge concerning conventional techniques such as wet development and development at temperatures near ordinary temperature.

The above-described reactions proceed especially efficiently, producing increased image density, in the presence of organic silver salt oxidizing agents. It is, therefore, especially preferred to use such organic silver salt oxidizing agents in combination.

The dye releasing redox compound which releases a hydrophilic diffusible dye used in the present invention is a compound described in European Patent Application (OPI) No. 76,492 as a dye releasing compound and is represented by the following general formula:

$$R_a—SO_2—D$$

wherein $R_a$ represents a reducing group capable of being oxidized by the silver halide; and D represents an image forming dye portion containing a hydrophilic group.

The above-described compound is oxidized corresponding to or reversely corresponding to latent image distributed imagewise in the silver halide and releases imagewise a mobile dye.

The detail definitions of $R_a$ and D, examples of the specific compounds and synthesis examples thereof are described in European Patent Application (OPI) No. 76,492.

As the dye releasing redox compounds used in the present invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published patent application Ser. No. B 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120, etc., are also effective in addition to the above-described compounds.

Further, the dye releasing redox compounds which release a yellow dye as described, for example, in U.S. Pat. Nos. 4,013,633, 4,156,609, 4,148,641, 4,165,987, 4,148,643, 4,183,755, 4,246,414, 4,268,625 and 4,245,028, Japanese Patent Application (OPI) Nos. 71072/81, 25737/81, 138744/80, 134849/80, 106727/77, 114930/76, etc., can be effectively used in the present invention.

The dye releasing redox compounds which release a magenta dye as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in the present invention.

The dye releasing redox compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., can be effectively used in the present invention.

Two or more of the dye releasing redox compounds can be used together. In these cases, two or more dye releasing redox compounds may be used together in order to represent the same color or in order to represent black color.

The dye releasing redox compounds are suitably used in a range from 10 mg/m$^2$ to 15 g/m$^2$ and preferably in a range from 20 mg/m$^2$ to 10 g/m$^2$ in a total.

The dye-releasing redox compounds used in the present invention can be incorporated in a layer of light-sensitive material by known techniques such as the method described in U.S. Pat. No. 2,322,027. In this case, high boiling and low boiling organic solvents as described above can be used.

In addition, the method of dispersion utilizing polymeric materials as described in Japanese Patent Publication No. 39853/76 and Japanese Patent Application (OPI) No. 59943/76 (the term "OPI" as used herein means a "published unexamined Japanese patent application") can be used. In dispersing the dye-releasing redox compounds in hydrophilic colloid, various surface active agents can be used. As these surface active agents, the compounds listed as surface active agents in other parts of the present specification can be used.

In the present invention, if necessary, a reducing agent may be used. The reducing agent in this case is the so-called auxiliary developing agent, which is oxidized by the silver halide and/or the organic silver salt oxidizing agent to form its oxidized product having an ability to oxidize the reducing group $R_a$ in the dye releasing redox compound.

Examples of useful auxiliary developing agents include the compounds specifically described in European Patent Application (OPI) No. 76,492.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its grain. That is, the silver halide which shows the X-ray diffraction pattern of pure silver iodide is particularly preferred.

In photographic materials a silver halide containing two or more kinds of halogen atoms can be used. Such a silver halide is present in the form of a completely mixed crystal in a conventional silver halide emulsion. For example, the grain of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver halide crystal in its grain and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds or sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic* Process, the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above-described dye releasing redox compound or a reducing agent coexisting, if necessary, with the dye releasing redox compound, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessarily to have the characteristic in that the silver halide contains pure silver iodide crystal in the case of using the silver halide alone. Any silver halide which is known in the art can be used.

Examples of such organic silver salt oxidizing agents include those described in European Patent Application (OPI) No. 76,492.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, etc., a cellulose derivative, a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, can be contained in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

As nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used in merocyanine dyes and complex merocyanine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material or in a dye fixing material as described later, if desired, according to the present invention is that which can endure at the processing temperature. As an ordinary support, not only glass, paper, metal or analogues thereto may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

It is advantageous to use a compound represented by the following general formula (C) in the heat-developable color photographic material in order to accelerate development and accelerate release of a dye.

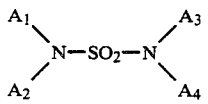

(C)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

The above-described compound can be used in an amount of broad range. A useful range is up to 20% by weight based on the total amount of coatings (dry basis) of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the present invention, it is possible to use a compound which activates development and stabilizes the image at the same time. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)-methylene-bis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, it is possible to use a thermal solvent. The term "thermal solvent" means a non-hydrolyzable organic material which meets at a temperature of heat treatment and meets at a lower temperature of heat treatment when it is present together with other components. Preferred examples of thermal solvents include compounds which can act as a solvent for the developing agent and compounds having a high dielectric constant which accelerate physical development of silver salts. Examples of preferred thermal solvents include those described in European Patent Application (OPI) No. 76,492.

In the present invention, though it is not always necessary to further incorporate substances or dyes for preventing irradiation or halation in the light-sensitive material, because the light-sensitive material is colored by the dye releasing redox compound, it is possible to add filter dyes or light absorbing materials, etc., into the light-sensitive material, as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention my contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

The photographic emulsion layer and other hydrophilic colloid layers in the light-sensitive material used in the present invention may contain various surface active agents for various purposes, for example, as coating aids, or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate salts, alkylbenzenesulfonate salts, alkylnaphthalenesulfonate salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. No. 2,648,604 and 3,671,247, Japanese Patent Publication Nos. 30074/69 and 9503/69, etc.

In the photographic light-sensitive material and the dye fixing material used in the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June 1978), for example, plasticizers, dyes for improving sharpness, antihalation dyes, sensitizing dyes, matting agents, fluorescent whitening agents and fading preventing agents, etc.

If necessary, two or more layers may be coated at the same time by the method as described in U.S. Pat. No. 2,761,791 and British Pat. No. 837,095.

Various means for exposure can be used in the present invention. Latent images are obtained by imagewise exposure by radiant rays including visible rays. Generally, light sources used in this invention include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful.

As the heating means, a simple heat plate, iron, heat roller, heat generator utilizing carbon or titanium white, etc., or analogues thereto may be used.

In the present invention, a specific method for forming a color image by heat development comprises transfer of a hydrophilic mobile dye. For this purpose, the heat-developable color photographic material used in the present invention is composed of a support having thereon a light-sensitive layer (I) containing at least silver halide, (optionally an organic silver saalt oxidizing agent), a dye releasing redox compound which is also a reducing agent for the organic silver salt oxidizing agent and a binder, and a dye fixing layer (II) capable of receiving the hydrophilic diffusible dye formed in the light-sensitive layer (I).

The above-described light-sensitive layer (I) and the dye fixing layer (II) may be formed on the same support, or they may be formed on different supports, respectively. The dye fixing layer (II) can be stripped off the light-sensitive layer (I). For example, after the heat-developable color photographic material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive layer.

Further, there is a method wherein only the light-sensitive layer (I) is exposed imagewise to light and heated uniformly by superposing the dye fixing layer (II) on the light-sensitive layer (I).

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer are formed on different supports.

Preferred polymer mordants used in the present invention can be polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming cobalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc., can be illustrated.

In addition, mordants disclosed in U.S. Pat. Nos. 2,675,316 and 2,882,156 can be used.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which can be observed through the transparent support is obtained.

Typical dye fixing material used in the present invention is obtained by mixing the polymer containing ammonium salt groups with gelatin and applying the mixture to a transparent support.

The transfer of dyes from the light-sensitive layer to the dye fixing layer can be carried out using a dye transfer assistant. Examples of useful dye transfer assistant include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant can be employed by wetting the image receiving layer with the transfer assistant or by incorporating it in the form of water of crystallization or microcapsules into the material.

The present invention will be explained in more detail by reference to the Examples given below, but the present invention is not limited thereto. In the Examples, the following dye releasing redox compounds were used.

Dye Releasing Redox Compound (1):

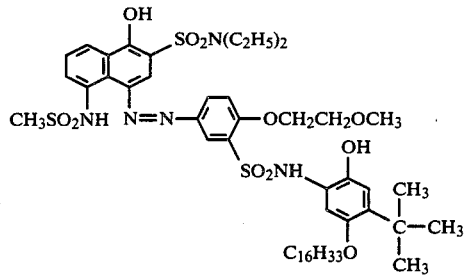

Dye Releasing Redox Compound (2):

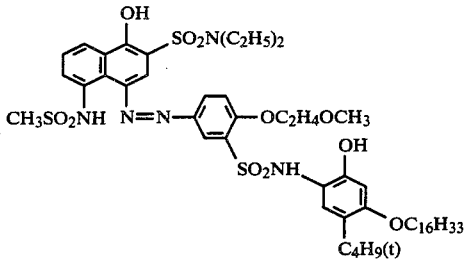

Dye Releasing Redox Compound (3):

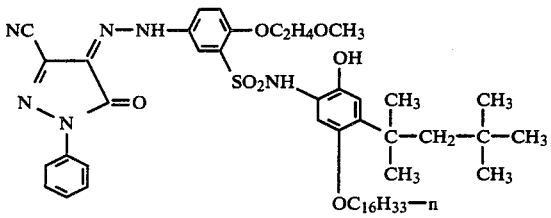

Dye Releasing Compound (4):

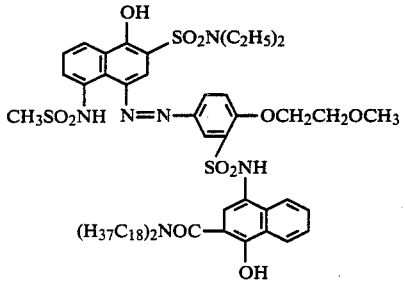

Dye Releasing Compound (5)

-continued

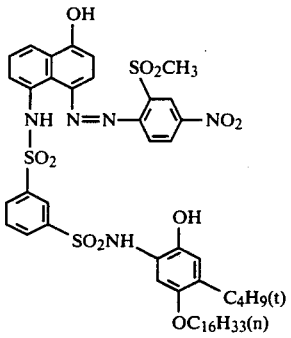

EXAMPLE 1

A mixture of 40 g of gelatin and 26 g of potassium bromide (KBr) was dissolved in 3,000 ml of water. This solution was stirred while maintaining at 50° C. Then a solution of 34 g of silver nitrate in 200 ml of water was added to the solution over 10 minutes.

A solution of 3.3 g of potassium iodide (KI) in 100 ml of water was then added thereto over 2 minutes.

The thus-prepared silver iodobromide emulsion was precipitated by adjusting the pH to remove excess salts.

The emulsion was then adjusted to pH 6.0. In this way, there was obtained 400 g of a silver iodobromide emulsion.

A method of preparing a gelatin dispersion of a compound of the present invention is described below.

To a mixture of 5 g of Dye-Releasing Redox Compound (1) having the chemical structure as described above, 0.5 g of sodium 2-ethylhexylsuccinate sulfonate and 5 g of Compound (23) of the present invention was added 30 ml of ethyl acetate. The mixture was then heated at about 60° C. to prepare a homogeneous solution. This solution was mixed with 100 g of a 10% solution of lime-treated gelatin and dispersed therein by the use of a homogenizer for 10 minutes at 10,000 rpm. This dispersion is called a "dispersion of a compound of the present invention".

A method of preparing a light-sensitive coated material is described below.

| | | |
|---|---|---|
| (a) | Light-sensitive silver iodobromide emulsion | 25 g |
| (b) | Dispersion of compound of the present invention | 33 g |
| (c) | Solution of 1.5 g of guanidine-trichloroacetic acid in 15 ml of ethanol | |
| (d) | 2.5 wt % Aqueous solution of the following compound: 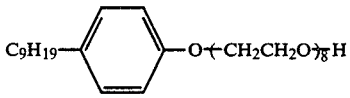 | 10 ml |
| (e) | 10 wt % Aqueous solution of dimethylsulfamide | 4 ml |

The above ingredients (a) to (e) were mixed, dissolved by heating at 40° C., and coated on a polyethylene terephthalate film in a wet coating thickness of 30 μm. A 3% by weight aqueous solution of gelatin was further coated thereon in a wet coating thickness of 30 μm to provide a protective layer. The thus-prepared coated material is designated as "Sample (1)".

For comparison, light-sensitive coated materials were prepared in the same manner as above except that Comparative Compounds (1) and (2) as described below were used in place of Compound (23) of the present invention. These light-sensitive coated materials are designated as "Sample (2)" and "Sample (2')".

Comparative Compound (1)

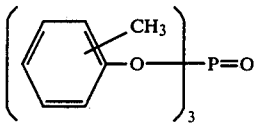

Comparative Compound (2)

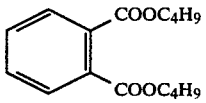

Each sample was exposed imagewise at 2,000 lux for 10 seconds by the use of a tungsten lamp and then uniformly heated for 30 seconds on a heat block maintained at 130° C.

A method of preparing a dye-fixing material with a dye-fixing layer is described below.

A 1:1 copolymer of methyl acrylate and N,N,N-trimethyl-N-vinylbenzylammonium chloride (10 g) was dissolved in 200 ml of water and uniformly mixed with 100 g of 10% lime-treated gelatin. In this mixture was dispersed titanium dioxide. The resulting dispersion was uniformly coated on a polyethylene-laminated paper support in a wet coating thickness of 90 μm. This material was dried and then used as a dye-fixing material.

The dye-fixing material was dipped in water and then the light-sensitive material heated immediately after coating was superposed on the dye-fixing material in such a manner that the coated layer were in contact with each other. They were then heated for 6 seconds on a heat block maintained at 80° C., and the dye-fixing material was stripped from the light-sensitive material, whereupon a negative magenta image was obtained on the dye-fixing material. This negative image was measured for the maximum density (Dmax) relative to green light and the fog density (Dmin) by the use of a Macbeth reflection densitometer (RD-519).

Samples (1), (2) and (2') were stored at room temperature for 3 months in a light-shielded condition and then exposed imagewise, heated and was subjected to a treatment to transfer a dye to the dye-fixing material under the same conditions as described above. The thus-obtained negative image was measured for the density to green light by the use of a Macbeth reflection densitometer (RD-519). The results are shown in Table 1.

TABLE 1

| | Just after Preparation | | After Storage for 3 Months | |
|---|---|---|---|---|
| Sample | Dmax | Dmin | Dmax | Dmin |
| (1) (Example of the Invention) | 1.67 | 0.29 | 1.78 | 0.41 |
| (2) (Comparative Example) | 1.83 | 0.35 | 2.33 | 1.92 |
| (2') (Comparative Example) | 1.75 | 0.30 | 2.04 | 1.43 |

It can be seen from Table 1 that the compound of the present invention prevents the formation of fog and a change in maximum density, and improves the stability with a passage of time.

EXAMPLE 2

In this example, an organic silver salt oxidizing agent was used.

Preparation of Silver Benzotriazole Emulsion

A mixture of 28 g of gelatin and 13.2 g of benzotriazole was dissolved in 3,000 ml of water. This solution was stirred while maintaining at 40° C. A solution of 17 g of silver nitrate in 100 ml of water was added thereto over 2 minutes.

The thus-prepared silver benzotriazole emulsion was adjusted in pH, precipitated, and freed of excess salts. Then the emulsion was adjusted to pH 6.0. In this way, there was obtained 400 g of a silver benzotriazole emulsion.

Using the silver benzotriazole emulsion, a light-sensitive coated material as described below was prepared.

| | | |
|---|---|---|
| (a) | Silver iodobromide emulsion of Example 1 | 20 g |
| (b) | Silver benzotriazole emulsion | 10 g |
| (c) | Dispersion (prepared in the same manner as in Example 1 except that Compound (23) was replaced by each of the compounds shown in Table 2 and Dye Releasing Redox Compound (1) was changed to Dye Releasing Redox Compound (2)) | 33 g |
| (d) | Solution of 1.6 g of guanidine-trichloroacetic acid in 16 ml of ethanol | |
| (e) | 2.5 wt % Aqueous solution of the following compound: 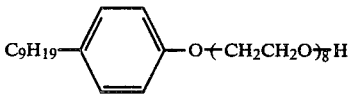 | 10 ml |
| (f) | 10 wt % Aqueous solution of dimethylsulfamide | 4 ml |

The above ingredients (a) to (f) were mixed, dissolved by heating at 40° C., and coated on a polyethylene terephthalate film in a wet coating thickness of 30 μm. A 3% aqueous solution of gelatin was coated thereon in a wet coating thickness of 30 μm to provide a protective layer.

In this way, Samples (3) to (8) and (9) (comparative example) were prepared.

TABLE 2

| Sample | Compound used in Dispersion |
|---|---|
| (3) | Compound (17) |
| (4) | Compound (16) |
| (5) | Compound (1) |
| (6) | Compound (2) |
| (7) | Compound (6) |
| (8) | Compound (35) |
| (9) | Comparative Compound (1) |

Samples (3) to (9) were each measured for the reflection density to green light just after the preparation and also after storage for 2 days in a thermostatic container at 50° C. in the same manner as in Example 1. The results are shown in Table 3 below.

TABLE 3

| | Just after Preparation | | After Storage at 50° C. for 2 Days | |
|---|---|---|---|---|
| Sample | Dmax | Dmin | Dmax | Dmin |
| (3) | 2.05 | 0.25 | 2.11 | 0.38 |
| (4) | 1.85 | 0.23 | 2.02 | 0.38 |
| (5) | 1.21 | 0.20 | 1.44 | 0.34 |
| (6) | 1.36 | 0.22 | 1.57 | 0.30 |
| (7) | 1.57 | 0.23 | 1.73 | 0.39 |
| (8) | 1.62 | 0.20 | 1.85 | 0.28 |
| (9) | 2.13 | 0.35 | 2.35 | 1.86 |

It can be seen from Table 3 that the compounds of the present invention prevent the formation of fog during storage and improve the stability with time.

EXAMPLE 3

Using the dispersion of the compounds of the present invention shown in Table 4, light-sensitive coated materials were prepared under the same conditions as in Example 2.

TABLE 4

| Sample | Compound used in Dispersion | Dye-Releasing Redox Compound | Hue |
|---|---|---|---|
| (10) | Compound (23) | (3) | Yellow |
| (11) | Comparative Compound (1) | (3) | " |
| (12) | Compound (23) | (4) | Magenta |
| (13) | Comparative Compound (1) | (4) | " |
| (14) | Compound (23) | (5) | Cyan |
| (15) | Comparative Compound (1) | (5) | " |

Samples (10) to (15) were each measured for the reflection density to blue, green and red light just after the preparation thereof and also after storage for 2 days in a thermostatic container at 50° C. in a light-shielded condition, under the same conditions as in Example 1. The results are shown in Table 5 below.

TABLE 5

| | Just after Preparation | | After Storage at 50° C. for 2 days | |
|---|---|---|---|---|
| Sample | Dmax | Dmin | Dmax | Dmin |
| (10) | 1.73 | 0.14 | 1.90 | 0.37 |
| (11) | 1.81 | 0.14 | 2.15 | 0.95 |
| (12) | 1.98 | 0.31 | 2.06 | 0.56 |
| (13) | 2.06 | 0.42 | 2.15 | 2.00 |
| (14) | 1.87 | 0.14 | 2.22 | 0.31 |
| (15) | 1.99 | 0.16 | 2.36 | 0.98 |

It can be seen from Table 5 that with Dye-Releasing Redox Compounds (3), (4) and (5), the use of the compounds of the present invention prevents the formation of fog and improves the stability with a passage time.

EXAMPLE 4

Samples (16) to (18) were prepared in the same manner as in Example 2 except that the compounds of the present invention and the dye-releasing redox compounds were replaced by the compounds of the present invention and the dye-releasing redox compound shown in Table 6 below.

TABLE 6

| Sample | Compound of the Invention | Dye-Releasing Redox Compound |
|---|---|---|
| (16) | (22) | (4) |
| (17) | (43) | (4) |

TABLE 6-continued

| Sample | Compound of the Invention | Dye-Releasing Redox Compound |
|---|---|---|
| (18) | (48) | (4) |

Samples (16) to (18) were each examined for the formation of fog just after the preparation and also after storage for 2 days in a thermostatic container at 50° C. In all cases, the formation of fog with a passage of time was prevented.

While the invention has been described in detail and with reference to specific embodiments thereof, it will be apparent to one skilled in the art that various changes and modifications can be made therein without departing from the spirit and scope thereof.

What is claimed is:

1. A method for forming an image which comprises:

imagewise exposing to light a heat developable color light-sensitive material comprising a support having thereon at least a light-sensitive silver halide, a binder and a dye releasing redox compound capable of reducing the silver halide and releasing a hydrophilic dye by reacting with the silver halide when heated; and heating the heat developable color light-sensitive material, after or simultaneously with the imagewise exposing, in the presence of a compound represented by the general formula (A) in a substantially water-free condition to form a mobile dye in an image pattern:

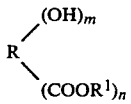

(A)

wherein R is an aliphatic hydrocarbon having a valence of m+n, $R^1$ is an aliphatic or aromatic group, and m and n each is an integer of 1 to 5, said compound represented by general formula (A) being present in an amount sufficient to improve the storage stability of the light-sensitive material.

2. A method for forming an image as claimed in claim 1, wherein R is a 2–6 valent saturated or unsaturated hydrocarbon group having 1 to 60 carbon atoms and $R^1$ is an aliphatic or aromatic group having 1 to 60 carbon atoms.

3. A method for forming an image as claimed in claim 2, wherein R is selected from the group consisting of an alkylene group, an alkenylene group, a trivalent alkyl radical and a tetravalent alkyl radical, and $R^1$ is selected from the group consisting of an alkyl group, a substituted alkyl group, an alkenyl group, a substituted alkenyl group, a cycloalkyl group, a substituted cycloalkyl group, a phenyl group and a substituted phenyl group.

4. A method for forming an image as claimed in claim 2, wherein R is a 2–5 valent saturated or unsaturated hydrocarbon group having 1 to 20 carbon atoms and $R^1$ is selected from the group consisting of an alkyl group having 1 to 20 carbon atoms and a cycloalkyl group having 1 to 20 carbon atoms.

5. A method for forming an image as claimed in claim 1, wherein m is 1, n is 1, and R is an alkylene or alkenylene group.

6. A method for forming an image as claimed in claim 1, wherein m is 1, n is 2, and R is a trivalent saturated hydrocarbon group.

7. A method for forming an image as claimed in claim 1, wherein m is 2, n is 2, and R is a tetravalent saturated hydrocarbon group.

8. A method for forming an image as claimed in claim 1, wherein m is 1, n is 3, and R is a tetravalent saturated hydrocarbon group.

9. A method for forming an image as claimed in claim 1, wherein the compound represented by the general formula (A) is present in an amount of 0.01 to 20 times the weight of the dye releasing redox compound.

10. A method for forming an image as claimed in claim 9, wherein the compound represented by the general formula (A) is present in an amount of 0.01 to 5 times the weight of the dye releasing redox compound.

11. A method for forming an image as claimed in claim 1, wherein the heating is performed at a temperature of above 80° C.

12. A heat developable color light-sensitive material, comprising:

a support having thereon;

a light-sensitive silver halide;

a binder a dye releasing redox compound which is reductive to the light-sensitive silver halide and releases a hydrophilic dye by causing a reaction with the light-sensitive silver halide by heating; and a compound represented by the general formula (A):

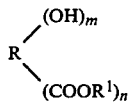

(A)

wherein R is an aliphatic hydrocarbon having a valence of m+n, $R^1$ is an aliphatic or aromatic group, and m and n each is an integer of 1 to 5, said compound represented by general formula (A) being present in an amount sufficient to improve the storage stability of the light-sensitive material.

13. A heat developable color light-sensitive material as claimed in claim 12, wherein R is a 2–6 valent saturated or unsaturated hydrocarbon group having 1 to 60 carbon atoms and $R^1$ is an aliphatic or aromatic group having 1 to 60 carbon atoms.

14. A heat developable color light-sensitive material as claimed in claim 13, wherein R is selected from the group consisting of an alkylene group, an alkenylene group, a trivalent alkyl radical and a tetravalent alkyl radical, and $R^1$ is selected from the group consisting of an alkyl group, a substituted alkyl group, an alkenyl group, a substituted alkenyl group, a cycloalkyl group, a substituted cycloalkyl group, a phenyl group and a substituted phenyl group.

15. A heat developable color light-sensitive material as claimed in claim 13, wherein R is a 2–5 valent saturated or unsaturated hydrocarbon group having 1 to 20 carbon atoms and $R^1$ is selected from the group consisting of an alkyl group having 1 to 20 carbon atoms and a cycloalkyl group having 1 to 20 carbon atoms.

16. A heat developable color light-sensitive material as claimed in claim 12, wherein m is 1, n is 1, and R is an alkylene or alkenylene group.

17. A heat developable color light-sensitive material as claimed in claim 12, wherein m is 1, n is 2, and R is a trivalent saturated hydrocarbon group.

18. A heat developable color light-sensitive material as claimed in claim 12, wherein m is 2, n is 2, and R is a tetravalent saturated hydrocarbon group.

19. A heat developable color light-sensitive material as claimed in claim 12, wherein m is 1, n is 3, and R is a tetravalent saturated hydrocarbon group.

20. A heat developable color light-sensitive material as claimed in claim 12, wherein the compound represented by the general formula (A) is present in an amount of 0.01 to 20 times the weight of the dye releasing redox compound.

* * * * *